US005333473A

United States Patent [19]

Miyamoto

[11] Patent Number: 5,333,473

[45] Date of Patent: Aug. 2, 1994

[54] SINKER MECHANISM FOR FLAT KNITTING MACHINES

[75] Inventor: Masaki Miyamoto, Wakayama, Japan

[73] Assignee: Shima Seiki Mfg., Ltd., Wakayama, Japan

[21] Appl. No.: 88,690

[22] Filed: Jul. 9, 1993

[30] Foreign Application Priority Data

Jul. 9, 1992 [JP] Japan ..... 4-182649

[51] Int. Cl.[5] ..... D04B 15/06

[52] U.S. Cl. ..... 66/106; 66/64; 66/109

[58] Field of Search ..... 66/60 R, 64, 90, 104, 66/106, 109

[56] References Cited

U.S. PATENT DOCUMENTS

| | | | |
|---|---|---|---|
| 570,335 | 10/1896 | Powell | 66/64 |
| 1,339,708 | 5/1920 | Lippitt | 66/106 X |
| 1,653,886 | 12/1927 | Billings | 66/106 |
| 1,782,298 | 11/1930 | Grieve | 66/106 |
| 3,326,017 | 6/1967 | Tschumperlin et al. | 66/109 X |
| 5,134,864 | 8/1992 | Yabuta et al. | 66/106 |
| 5,134,865 | 8/1992 | Shima et al. | 66/106 |

FOREIGN PATENT DOCUMENTS 3-152249 6/1991 Japan .

*Primary Examiner*—Clifford D. Crowder
*Assistant Examiner*—John J. Calvert
*Attorney, Agent, or Firm*—Edwin E. Greigg; Ronald E. Greigg

[57] ABSTRACT

A sinker mechanism for a flat knitting machine having at least one front needle bed and one rear needle bed, is provided with a row of sinker assemblies, each sinker assembly having a needle plate, a swingable sinker next to a front region of the needle plate, and a yarn guide sheet fixedly mounted to a needle bed, the swingable sinker having at front end a yarn holding portion, the yarn guide sheet having at front end a yarn guide edge, and when the swingable sinker turns forward with its yarn holding portion moving down, the yarn guide edge of the yarn guide sheet comes above the yarn holding portion of the swingable sinker and projects outwardly of the front end of the sinker towards an intermediate position between the front ends of the opposite needle beds.

2 Claims, 12 Drawing Sheets

SINKER MECHANISM FOR FLAT KNITTING MACHINES

BACKGROUND OF THE INVENTION

The present invention relates to a sinker mechanism installed in a flat knitting machine of which front end rear needle beds are arranged to face each other with their distal ends.

A conventional mechanism of sinkers disposed to the front ends of the needle beds of the flat knitting machine is based on an assembly of a swingable sinker which serves as a yarn guide and a stationary loop forming plate having an edge for forming a loop of yarn. In action, the swingable sinker on each needle bed turns forward to close the distance between the two needle beds and to guide the yarn fed from a yarn feeder to a lower position. Because of the action of the sinker mechanism, the previously formed loop of the yarn held on a knitting needle can be prevented from slipping off when the knitting needle advances to catch the yarn with its hook to form a new loop.

Also, another conventional sinker mechanism permits each sinker to have a loop forming edge portion shaped of a substantially arcuate configuration and a yarn holding portion provided in front of the loop forming edge. In action, as the sinker swings forward, its yarn holding portion presses down the previously formed loop to a lower position beneath the front end of the needle bed so that the previously formed loop is prevented from slipping off.

The former of the two conventional sinker mechanisms has however a drawback that the sinker acts as a yarn guide and also, as a loop slip-off preventing member and thus, provides a reduced force in pressing down the previously formed loop. Particularly, during the forming of loose loops of yarn, it often happens that the previously formed loop is not released from the latch of a knitting needle.

The sinker of the latter certainly presses down the previously formed loop with its yarn holding portion preventing the production of double loops. However, the yarn to be fed to the hook of the next knitting needle is drawn from a yarn feeder over the loop forming edge of the sinker and thus, tends to be carried above the hook. As the result, the yarn fails to be caught by the hook of the knitting needle and will not be looped.

OBJECT OF THE INVENTION

It is an object of the present invention to provide an improved sinker mechanism for a flat knitting machine which is capable of pressing down the previously formed loop without fail and also, guiding the yarn to the hook of a knitting needle.

SUMMARY OF THE INVENTION

For achievement of the foregoing object, a sinker mechanism for a flat knitting machine according to the present invention comprises a row of sinker assemblies , each sinker assembly consisting of a combination of a needle plate, a swingable sinker provided next to a front region of the needle plate, and a yarn guide sheet fixedly mounted to a needle bed. The needle plates are arranged at equal intervals on each needle bed of the flat knitting machine and each knitting needle is disposed between any two adjacent needle plates for advancing and retracting movement. The swingable sinker has at front end a yarn holding portion and the yarn guide sheet has at front end a yarn guide edge. In action, when the swingable sinker swings forward with its yarn holding portion moving down, the yarn guide edge of the yarn guide sheet remains in position and occupies a space above the yarn holding portion of the swingable sinker and projects outwardly of the front end of the sinker towards an intermediate position or space between the front ends of the opposite needle beds.

The yarn guide sheet is formed of a specific side-view shape such that its yarn guide edge hangs over the front end of the needle bed and the lowermost of the yarn guide edge remains situated on or beneath the line along which the center of the hook of the knitting needle travels.

DETAILED DESCRIPTION OF THE PREFERRED EMBODIMENT

Figure 1:
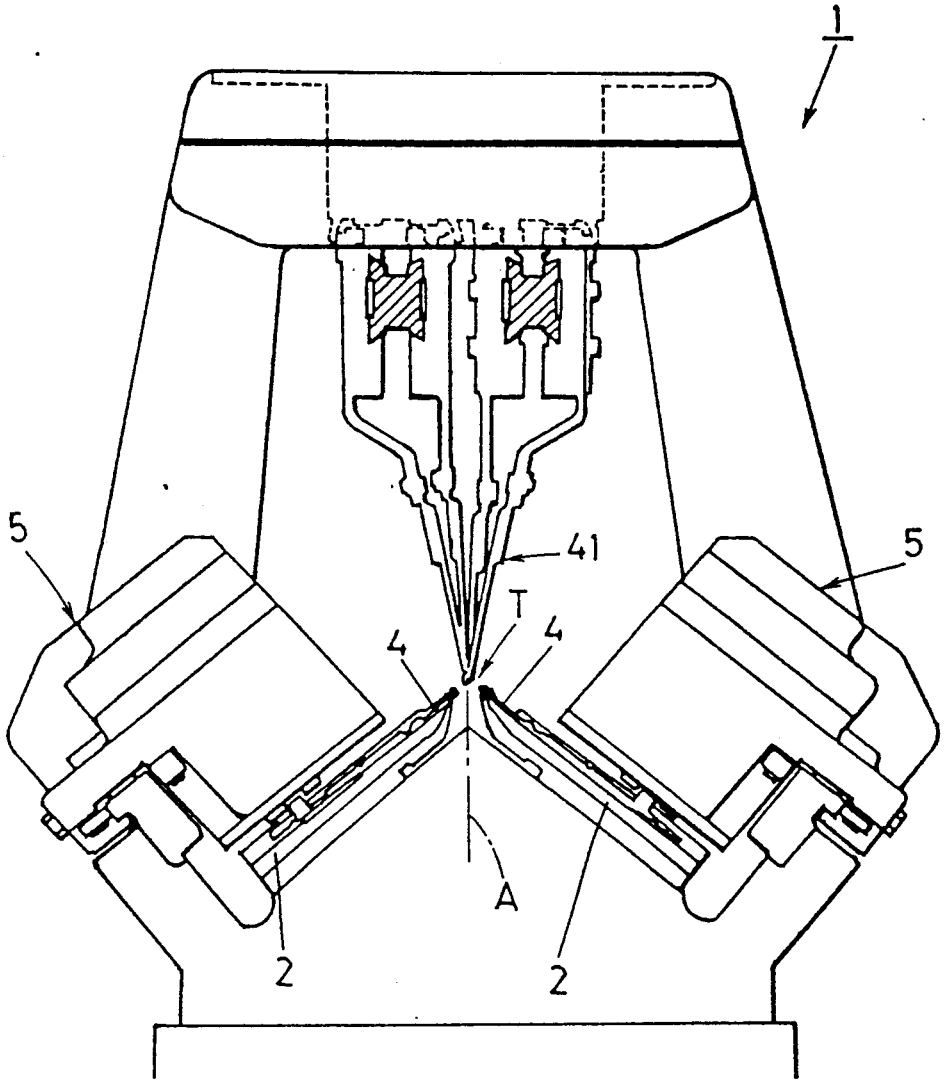
FIG. 1 is a schematic side view showing a main construction of a flat knitting machine.
Figure 2:
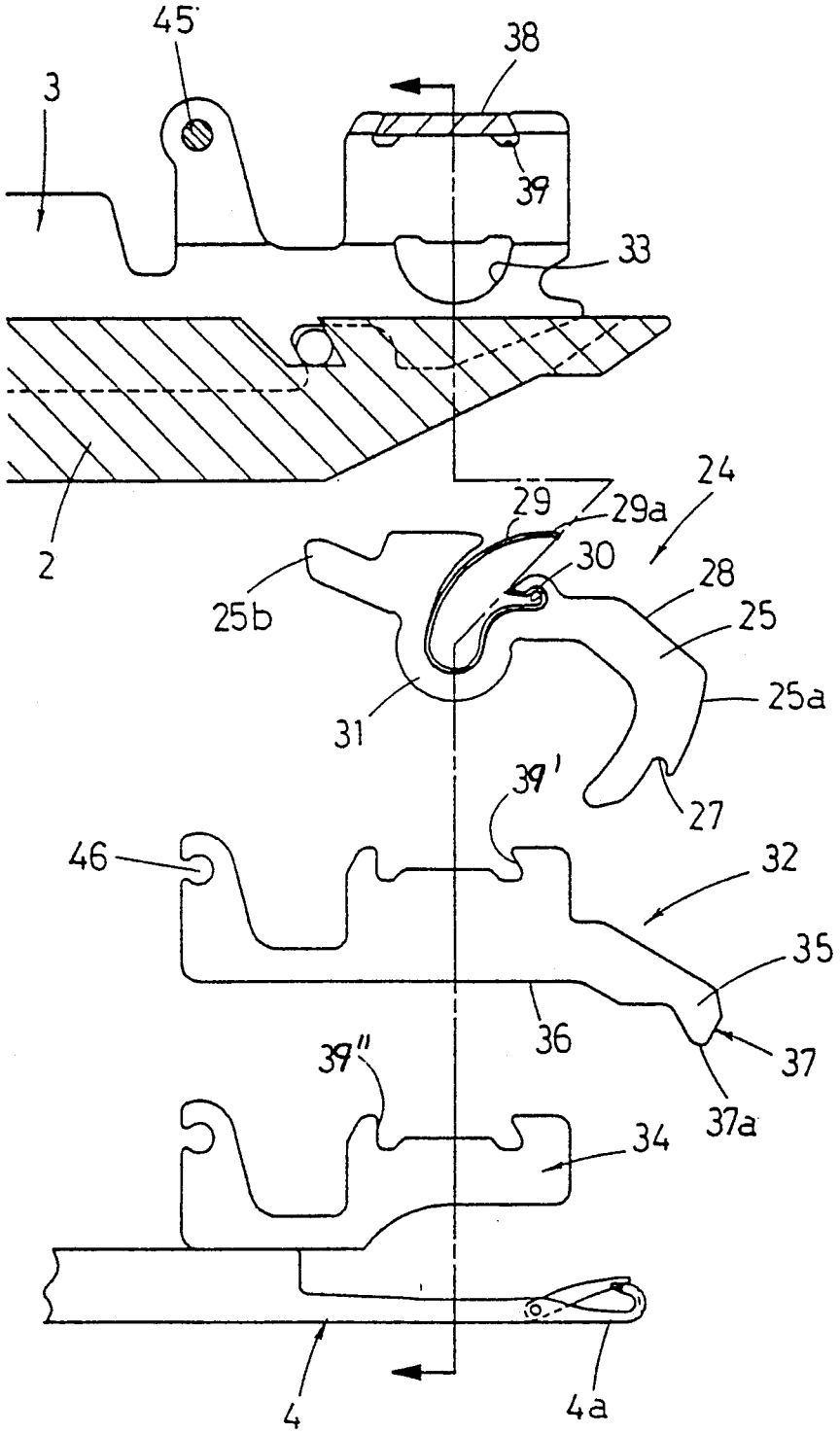
FIG. 2 is an exploded view of a sinker assembly.

FIG. 1 is a schematic side view showing a main construction of a flat knitting machine which is denoted by the numeral 1. The flat knitting machine I has a couple of needle beds 2 on which a multiplicity of needle plates 3 are arranged at equal intervals, as shown in FIG. 2. A retract-able knitting needle 4 of latch type is disposed between any two adjacent needle plates 3. The two needle beds 2 are arranged to have an inverted-V shape in cross section allowing their opposite knitting needles 4 to come close to each other with the distal ends.

A space T is formed between the ends of the needle plates on the front needle bed and the ends of the needle plates on the rear needle bed. The knitting needles 4 of each needle bed 2 are movable forward and backward as driven by means of the linear motion of a carriage 5.

Figure 3:
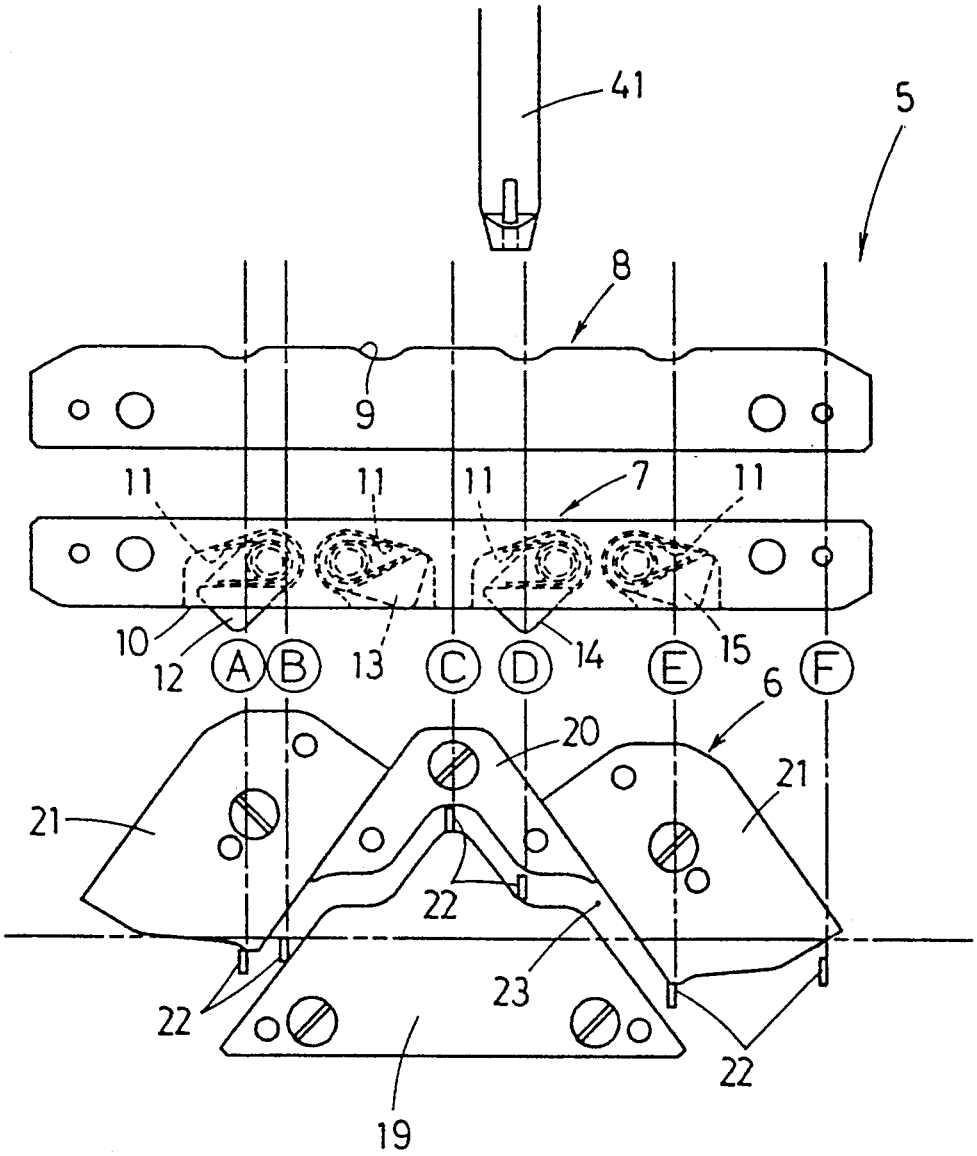
FIG. 3 is a schematic exploded view of a primary part of a carriage for controlling a knitting needle and a sinker.

FIG. 3 is a enlarged explanatory view showing the forward and backward movement of the knitting needle 4 and the interaction between cams of the carriage 5 and a sinker 24 which will be described later in more detail. A group of the cams of the carriage 5 includes a knitting cam member 6, a sinker controlling rear cam member 7 disposed in front of the knitting cam member 6, and a sinker controlling front cam member 8 disposed in front of the rear cam member 7.

Figure 4:
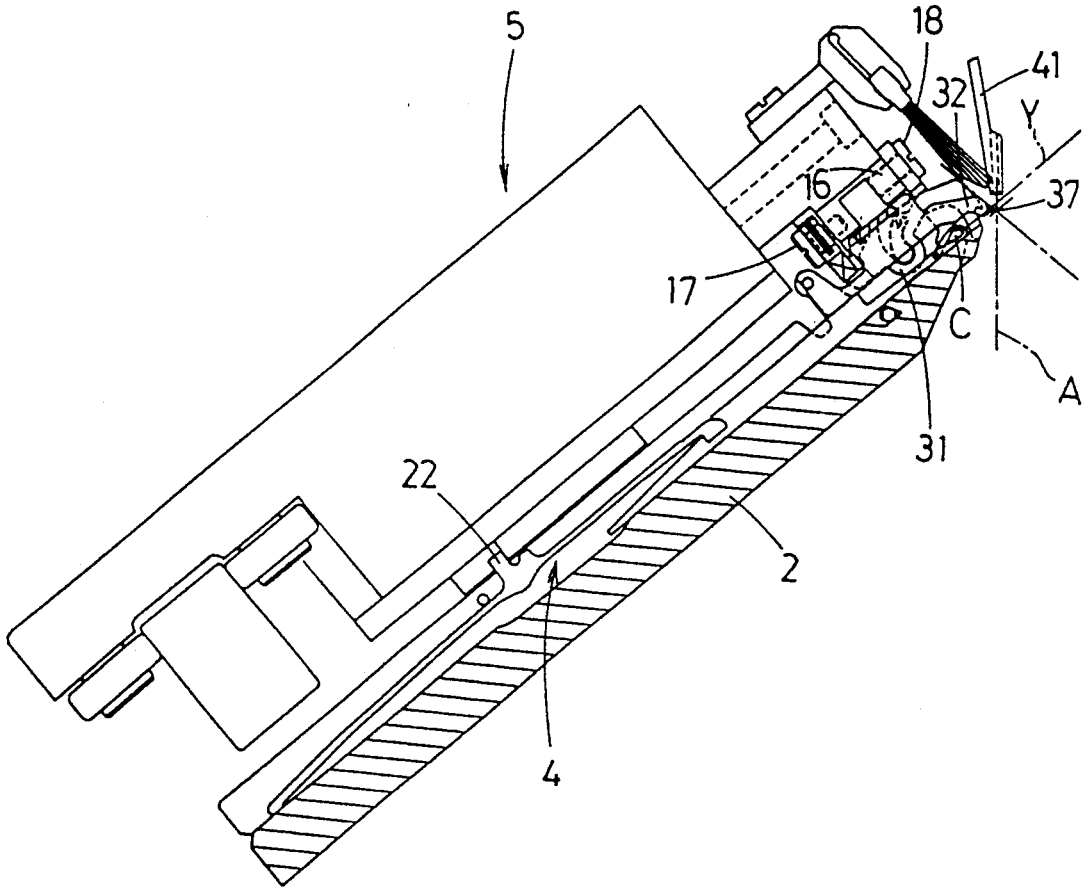
FIG. 4 is a side view of the sinker assembly.

The sinker controlling front cam member 8 is a plate having at lower end cam profiles 9 . The sinker controlling rear cam member 7 is also a plate having at lower end cam profiles 10 and provided with movable cams 12, 13, 14, and 15 which are urged by their respective coil springs 11 to project outwardly from the cam profile 10. The two cam members 7 and 8 are fixedly mounted by retaining bolts 17 and 18 respectively to a bracket 16 which extends from the carriage 5 (FIG. 4). The two movable cams 12 and 14 of the rear cam member 7 are for forward movement and the other movable cams 13 and 15 are for backward movement.

The knitting cam member 6 comprises a needle raising cam 19 of shouldered triangle shape, a main header 20 disposed just above the needle raising cam 19, and two sub headers 21 arranged movable along the two slopes of the main head 20. A control passage 23 is provided between the needle raising cam 19 and the three heads 20 and 21 for movement of a butt 22 of the knitting needle 4.

Figure 5:
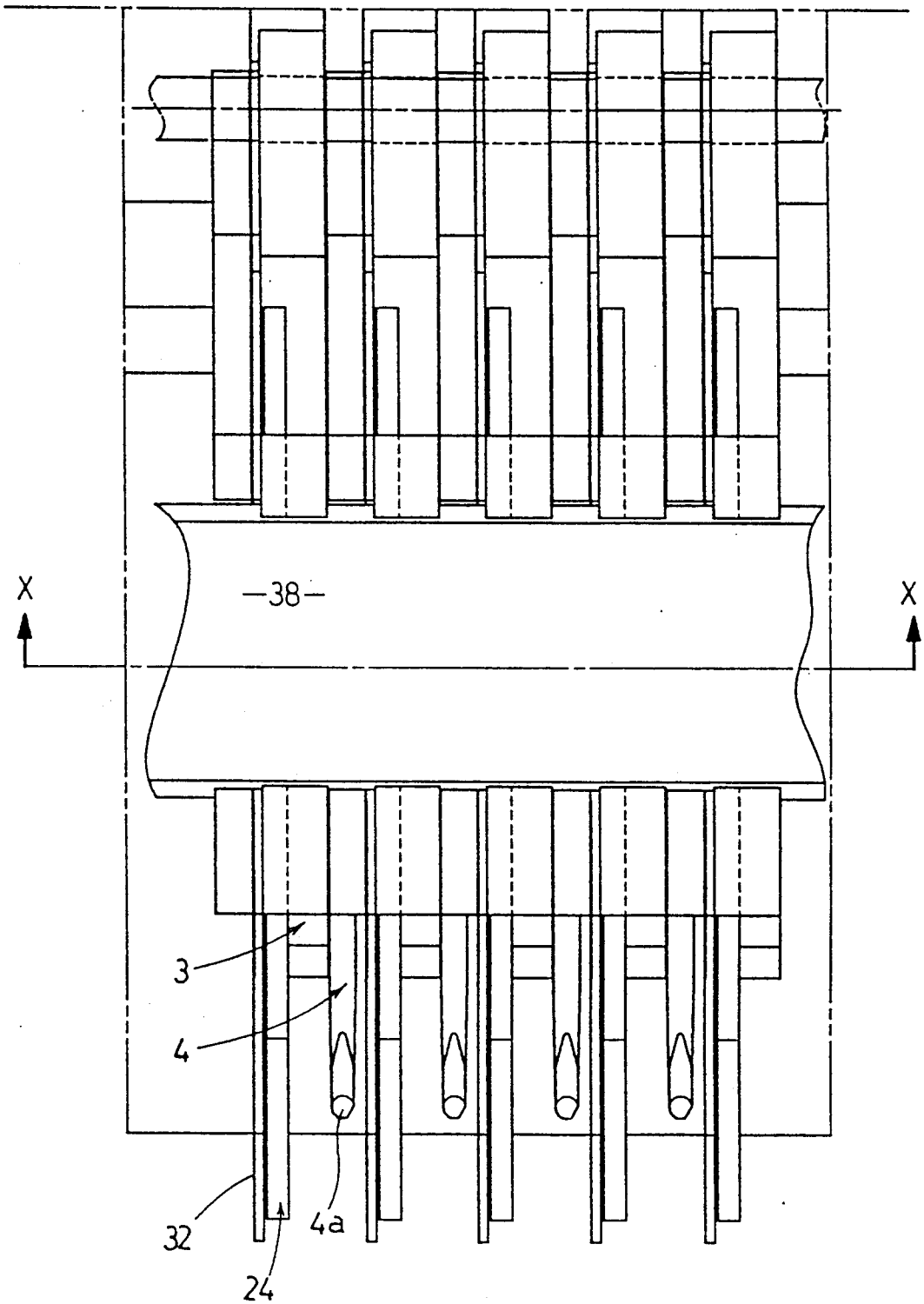
FIG. 5 is a plan view of the sinker assembly.

As best shown in FIG. 5, the knitting needle 4 controlled by the knitting cam member 6 is arranged next to the needle plate 3 on the needle bed 2 so that its hook 4*a* between the needle plates 3 can advance from and retract into the needle bed 2. The movable sinker 24 is mounted to the needle plate 3. A spacer 34 is disposed on the knitting needle 4.

Figure 6:
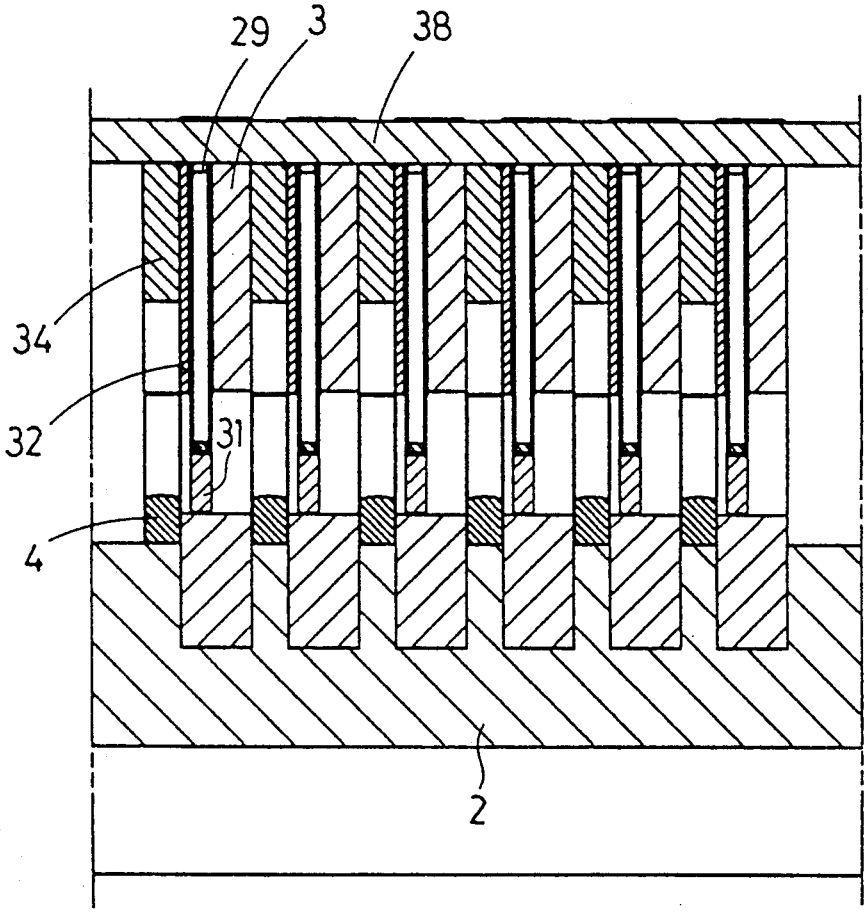
FIG. 6 is a cross sectional view taken along the line X—X of FIG. 5.

The movable sinker 24 includes a sinker plate 25 which is accompanied with a yarn guide sheet 32 so that the plate 25 and the sheet 32 are sandwiched directly between the needle plate 3 and the spacer 34 above the knitting needle 4, as shown in FIGS. 2, 5, and 6. The sinker plate 25 is controlled by the front cam member 8 and the rear cam member 7 for swing motion.

Referring again to FIG. 2 in particular, the sinker plate 25 has at front end a yarn holding portion 27 for holding a yarn, a front cam contact portion 28 provided substantially in the rear of the yarn holding portion 27 for direct contact with the front cam member 8, and a spring retainer portion 30 provided in rear of the front cam contact portion 27 and holding one end of a U-shaped leaf spring 29 which can urge the yarn holding portion 27 against the yarn.

The sinker plate 25 also has a swing center portion 31 of downwardly extending semi-circular shape provided in rear of the spring retainer portion 30. The rear end of the sinker 25 is a rear cam contact portion 25*b* for direct contact with the rear cam member 7.

The needle plate 3 has its upper half recessed to accept the thickness of the sinker plate 25 and the yarn guide sheet 32 and also includes a semi-circular recess 33 provided therein beneath the upper recessed portion for holding the swing center portion 31 of the sinker plate 25 closely so that the sinker plate 25 can swing in a narrow space between the needle plate 3 and the yarn guide sheet 32.

The yarn guide sheet 32 is a thin steel plate having at rear end a pivot recess 46 which is fitted onto a pivot rod 45 mounted lengthwisely of the needle bed 2, at center an engaging notch 39 identical to that of the spacer 34, and at front end a yarn guide portion 35.

The yarn guide portion 35 of the yarn guide sheet 32 has a yarn guide edge 37 extending diagonally downwardly from a bottom edge 36 of the yarn guide sheet 32 to the center line A between the two needle beds 2. More particularly, the yarn guide edge 37 of the yarn guide sheet 32 projects from the front end 25*a* of the sinker plate 25 and hangs over the front end of the needle bed 2.

Figure 7:
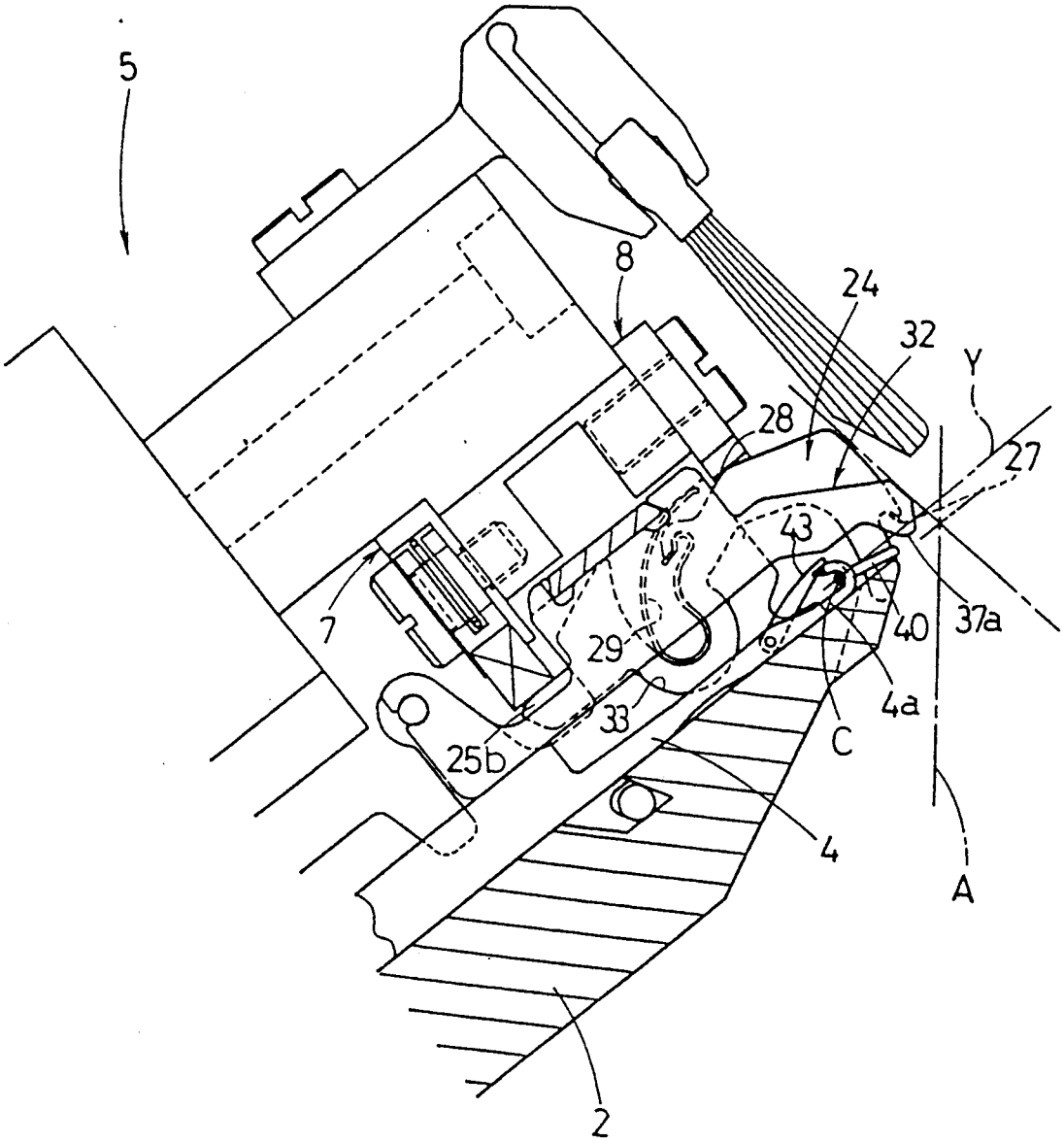
FIG. 7 is a side view of the sinker assembly with the sinker positioned at the location A in FIG. 3.

Also, the yarn guide edge 37 is positioned so that its lowermost extent 37*a* comes up to a height level Y best shown in FIG. 7 defined by the center C of the hook 4*a* of the knitting needle 4 during the advancing and retracting motion.

The spacer 32 and the guide sheet 34 are held in the needle plate 3 with their notches 39', 39 respectively engaging with a holding plate 38 of the needle plate 3. Simultaneously, the holding plate 38 of the needle plate 3 presses against a free end 29*a* of the leaf spring 29 causing the yarn holding portion 27 of the sinker plate 25 to remain urged downward.

The action of the flat knitting machine 1 equipped with the foregoing sinker mechanism will now be explained.

When the movable sinker 24 is at the location A in FIG. 3 during the movement of the carriage 5 from right to left, its associated knitting needle 4 stays retracted from the front end of the needle bed 2 as shown in FIG. 7. As the sinker plate 25 has been turned to left about its swing center 31 held in the semi-circular recess 33 of the needle plate 3 by the action of the cam 12 of the rear cam member 7 against the rear cam contact portion 25*b*, its front cam contact portion 28 comes in direct contact with the front cam member 8 and its yarn holding portion 27 hangs over the knitting needle 4.

When the movable sinker 24 comes to the location B in FIG. 3, the needle raising cam 19 of the knitting cam member 6 lifts up the butt 22 causing the hook 4*a* of the knitting needle 4 to project to a small distance from the front end of the needle bed 2.

Figure 8:
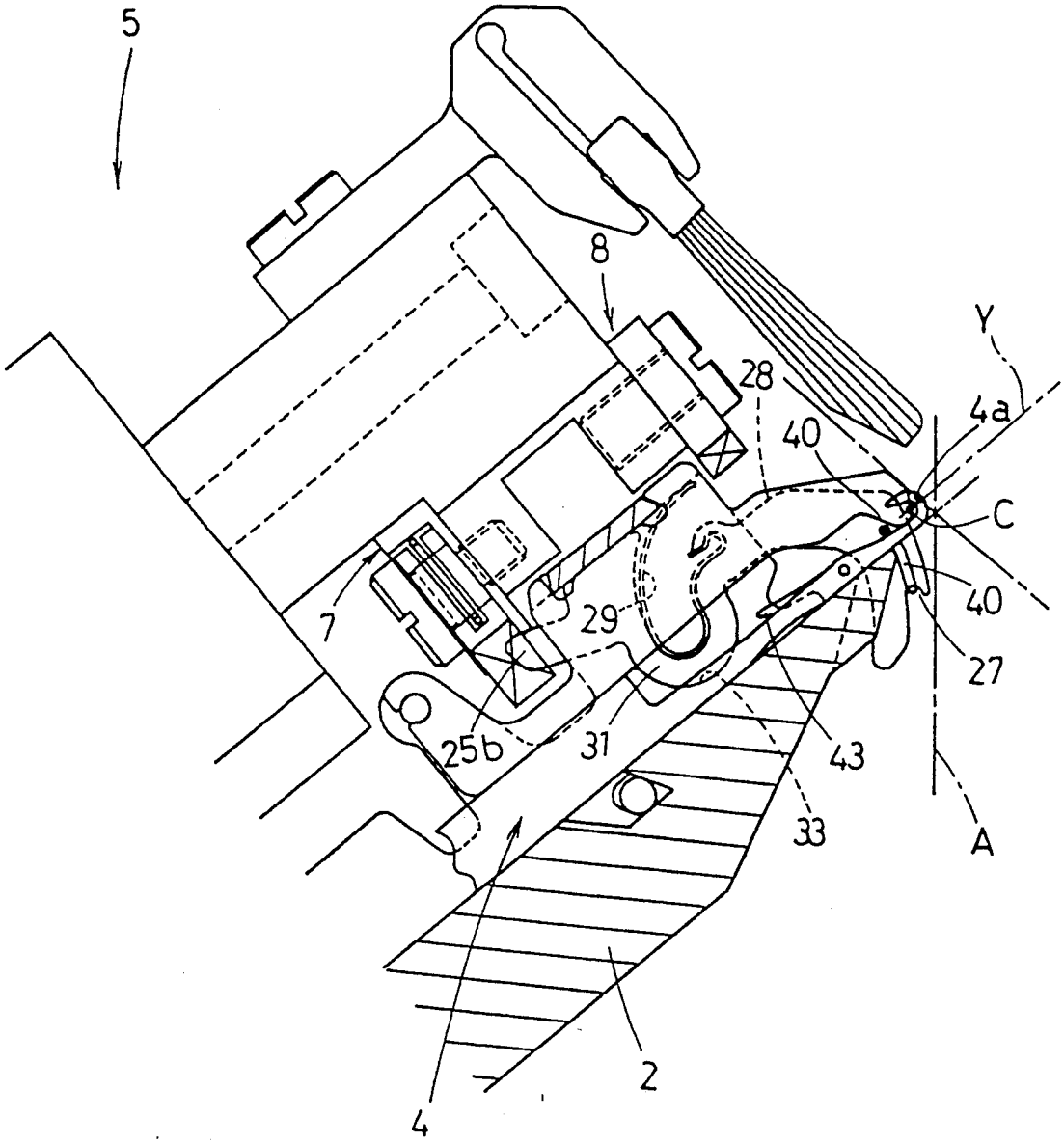
FIG. 8 is a side view of the sinker assembly with the sinker positioned at the location B in FIG. 3.

At that time, the movable sinker 24 is turned to right by the yielding force of the leaf spring 29 causing the yarn holding portion 27 of the sinker plate 25 to move down to beneath the knitting needle 4 while holding the previously formed loop of a yarn 40, as shown in FIG. 8.

Figure 9:
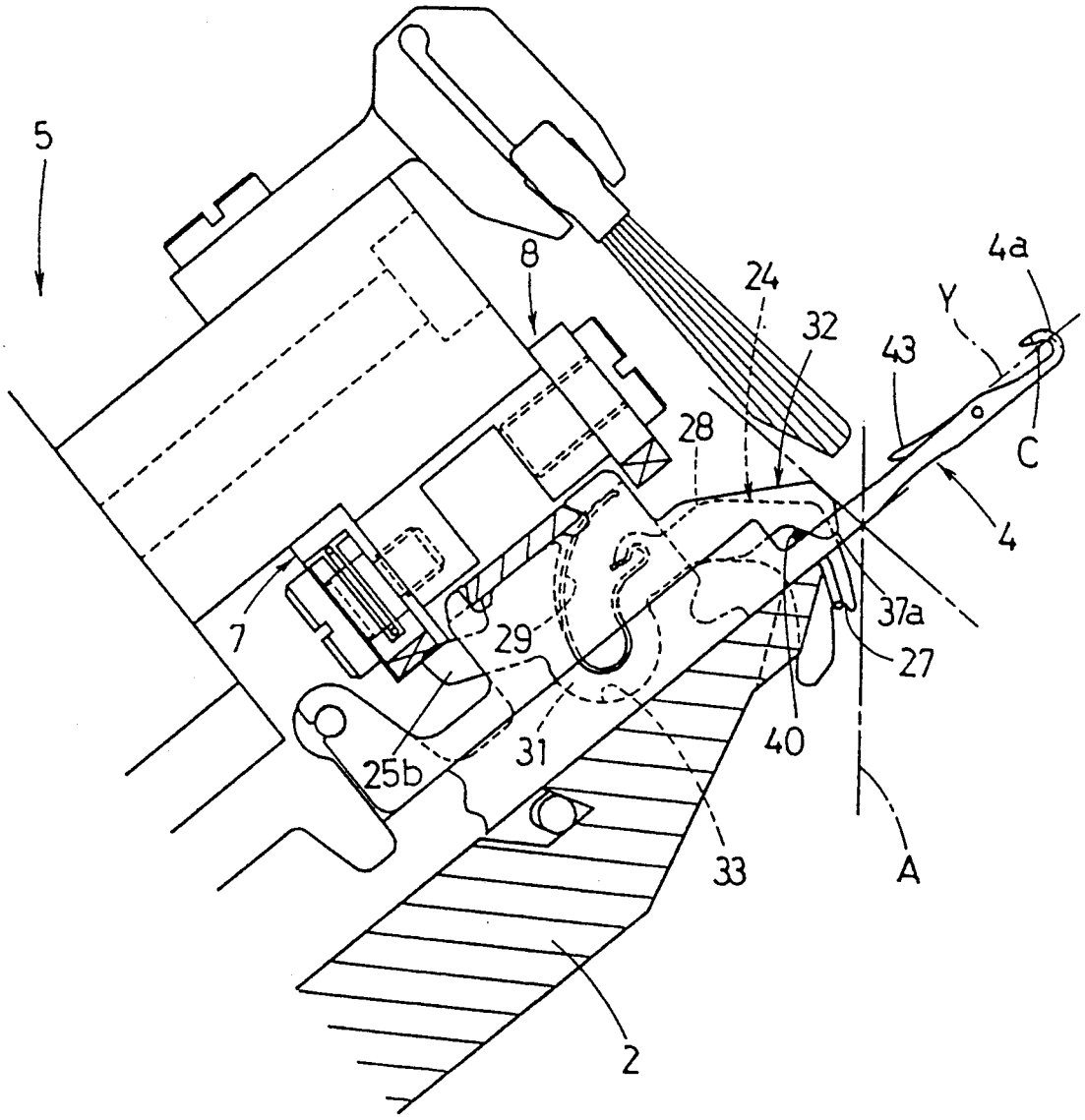
FIG. 9 is a side view of the sinker assembly with the sinker positioned at the location C in FIG. 3.

When the carriage 5 goes further to left and the sinker 24 comes to the location C, the butt 22 is lifted up to the peak of the needle raising cam 19 causing the hook 4*a* of the knitting needle 4 to project further from the front end of the needle bed 2, as shown in FIG. 9.

As the knitting needle 4 advances, a latch 43 of its hook 4*a* is opened by the previously formed yarn loop 40 since the sinker plate 25 is balanced at a press-down position 39 between the tension of the previously formed yarn loop 40 held on the yarn holding portion 27 of the sinker plate 25 and the yielding force of the leaf spring 29. If the tension of the previously formed yarn loop 40 becomes greater, the yarn holding portion 27 of the sinker plate 25 will move upward in the swing action to release an excess of the tension. Accordingly, the previously formed yarn loop 40 held on the yarn holding portion 27 remains at a constant tension.

Figure 10:
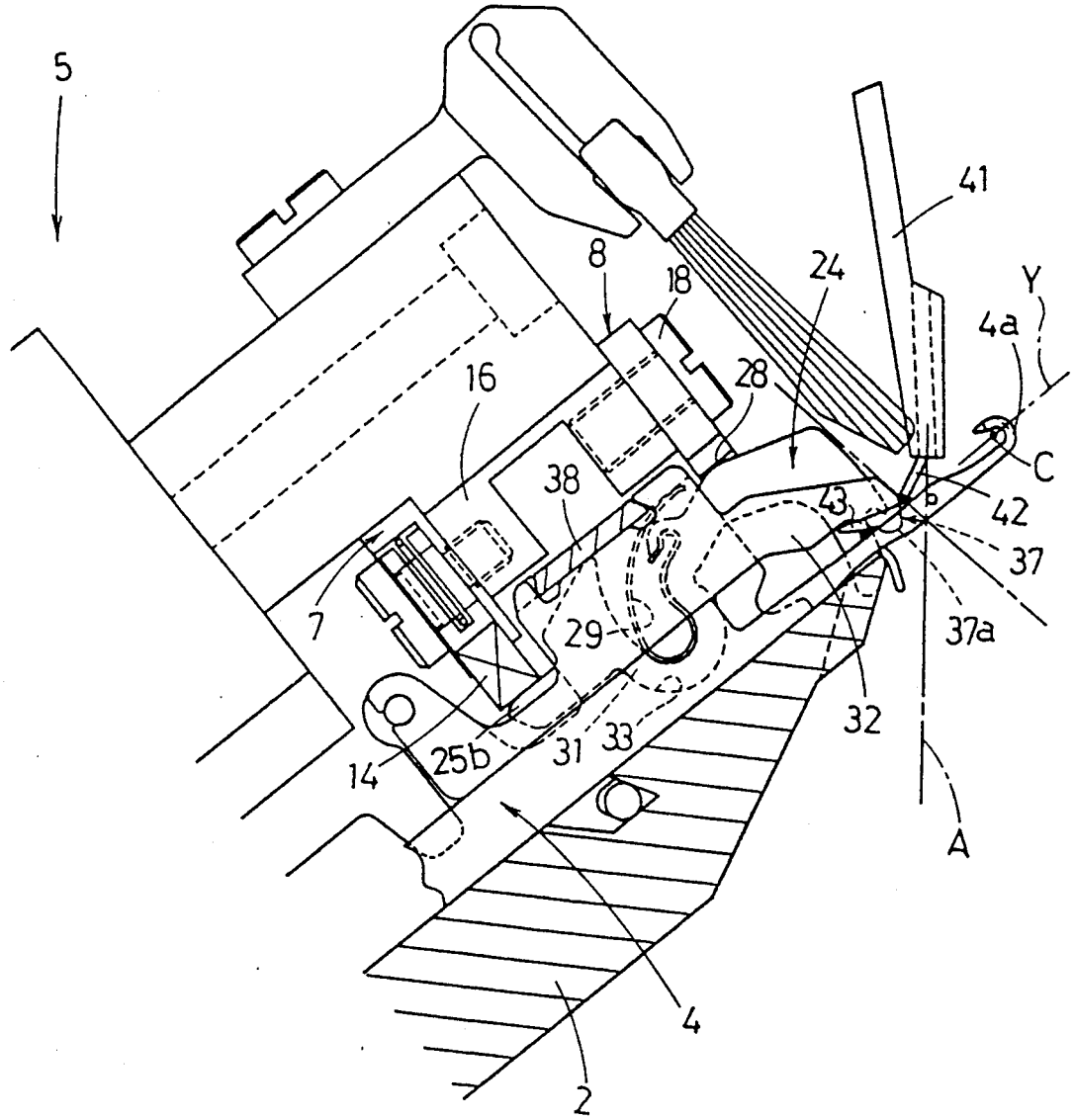
FIG. 10 is a side view of the sinker assembly with the sinker positioned at the location D in FIG. 3.

When the carriage 5 goes again to left and the sinker 24 comes to the location D in FIG. 3, the main header 20 of the knitting cam member 6 presses down the butt 22 causing the hook 4*a* of the knitting needle 4 to engage with a yarn 42 newly fed from a yarn feeder 41, as shown in FIG. 10.

At the time, the rear cam contact portion 25*b* of the sinker plate 25 is pressed down by the cam 14 of the rear cam member 7 causing the sinker plate 25 to turn to left about its swing center portion 31. Thus, the yarn holding portion 27 of the sinker plate 24 moves upwardly close to the knitting needle 4 and releases the previously formed yarn loop 40 from the hook 4*a* of the knitting needle 4. The latch 43 of the hook 4a comes opened to a knockover standby position.

Figure 11:
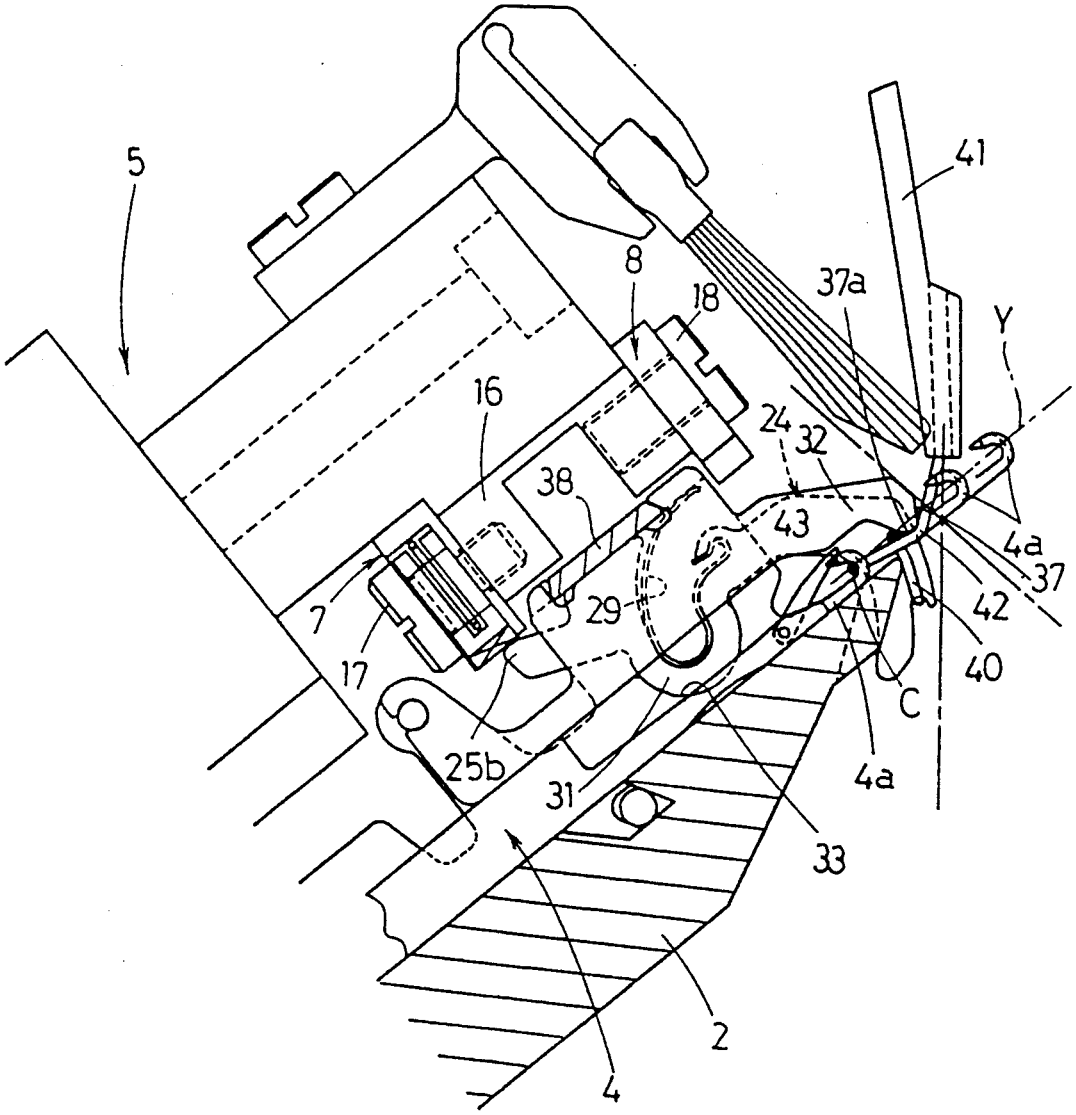
FIG. 11 is a side view of the sinker assembly with the sinker positioned at the location E in FIG. 3.

When the sinker 24 is at the location E in FIG. 3, the sub header 21 of the knitting cam member 6 pressed down the butt 22 causing the latch 43 of the knitting needle 4 to close. As the latch 43 is closed, the previously formed yarn loop 40 is knocked over and the knitting needle 4 retracts from the front end of the needle bed 2 (See FIG. 11).

The yarn 42 extending from the yarn feeder 41 over the sinker 24 to the hook 4a of the knitting needle comes into contact with the yarn guide edge 37 of the yarn guide sheet 32 and then, slides down along the yarn guide edge 37 to the distal end 37a of the yarn guide sheet 32 (which locates on the line Y along which the center C of the hook 4a of the knitting needle 4 travels). As the result, the yarn 42 extends down from the yarn feeder 41 to this lower position and can securely be held on the hooks 4a of the knitting needles 4 of the bed 2 one after another as the carriage 5 travels forward.

As the location shifts from D to E, the previously formed yarn loop 40 removes from the hook 4a of the knitting needle 4 through opening the latch 43 and after the retracting movement of the knitting needle 4 closes the latch 43, it runs on the closed latch 43 before being knocked over. The loop to be knocked over is stressed when the hook 4a of the knitting needle 4 passes through the loop, thus tensioning the previously formed yarn loop 40 held on the yarn holding portion 27 of the sinker plate 25. When the tension is exerted on the yarn holding portion 27, it is offset by a leftward swing motion of the sinker plate 25 about its swing center portion 31 against the yielding force of the leaf spring 29. Hence, the tension on the yarn 40 held on the yarn holding portion of the sinker plate 25 remains unchanged.

When the carriage 5 moves to left and the sinker 24 is at the location F in FIG. 3, the sub header 21 of the knitting cam member 6 holds the butt 22 at a slightly higher level than that at the location E. As the result, the hook 4a of the knitting needles 4 advances towards the front end of the needle bed 2 causing the previously formed loop 40 on the hook 4a to release the tension. The release of the tension is however prevented by the downward movement of the yarn holding portion 27 of the sinker plate 25 produced by the yielding force of the leaf spring 29. Accordingly, the previously formed yarn loop 40 on the hook 4a of the knitting needle 4 remains tensioned and will hardly loosen off.

Figure 12:
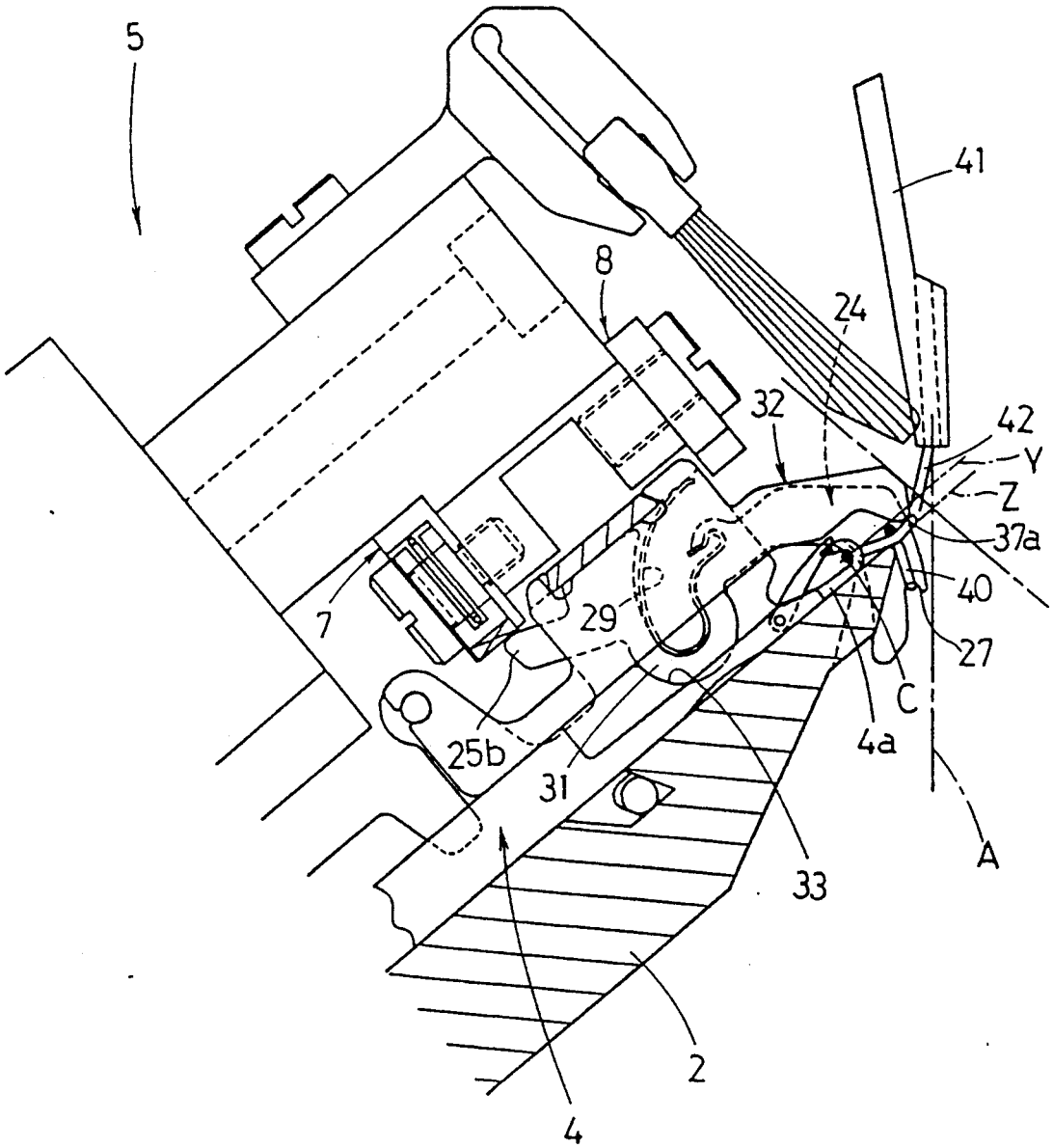
FIG. 12 is a side view of the sinker assembly with the sinker positioned at the location F in FIG. 3.

Referring now to FIG. 12, although the lower limit of the movement of the yarn guide edge 37 of the yarn guide sheet 32 in the embodiment is defined by the line Z lower than the line Y along which the center C of the hook 4a of the knitting needle 4 travels, it may be on or slightly above the line Y with equal success.

It is understood that the present invention is not limited to the latch type knitting needles 4 and applicable to known compound type knitting needles of which crooks are opened and closed by action of a slider.

Although the means for urging the yarn holding portion 27 of the sinker plate 25 in the embodiment is the U-shaped leaf spring 29, it will be any appropriate component, e.g. a coil spring, or may be omitted if desired.

Also, the sinker plate 25 may pivotably be mounted to the needle bed rather than held in the semi-circular recess of the needle plate 3 for swing action.

The foregoing relates to a preferred exemplary embodiment of the invention, it being understood that other variants and embodiments thereof are possible within the spirit and scope of the invention, the latter being defined by the appended claims.

What is claimed is:

1. A sinker mechanism for a flat knitting machine, the knitting machine having at least one front needle bed and one rear needle bed, each of the needle bed having needle plates which are arranged at equal intervals on the needle bed and knitting needles which are disposed between any two adjacent needle plates for advancing and retracting movement, the needle plates on the front needle bed and the needle plates on the rear needle bed facing each other in close relationship forming an intermediate space, comprising:

a row of sinker assemblies, each sinker assembly comprising a needle plate, a swingable sinker next to a front region of the needle plate, and a yarn guide sheet fixedly mounted to a needle bed, the swingable sinker having at a front end thereof a yarn holding portion, the yarn guide sheet having at a front end thereof a yarn guide edge, wherein, when the swingable sinker swings forward with the yarn holding portion moving downward from the needle plate, the yarn guide edge of the yarn guide sheet occupies a position above the yarn holding portion of the swingable sinker and projects outwardly of the front end of the sinker towards the intermediate space between the front ends of the opposite needle beds.

2. A sinker mechanism for a flat knitting machine as claimed in claim 1, wherein the yarn guide sheet is formed of a specific side-view shape such that the yarn guide edge hangs over the front end of the needle bed and a lowermost portion of the yarn guide edge remains situated on or beneath a line along which the center of a hook of a knitting needle travels.

* * * * *